United States Patent [19]

Wylie

[11] 4,044,694

[45] Aug. 30, 1977

[54] CHEQUE WRITING DESK AND CONTROL SYSTEM

[76] Inventor: Glenn John Wylie, 114 W. Deanepark Drive, Islington, Ontario, Canada

[21] Appl. No.: 616,252

[22] Filed: Sept. 24, 1975

[51] Int. Cl.[2] ..... A47B 41/04

[52] U.S. Cl. ..... 108/28; 108/60; 312/196

[58] Field of Search ..... 312/232, 233, 196, 194; 108/61, 28, 60; 40/124, 124.2, 124.4

[56] References Cited

U.S. PATENT DOCUMENTS

| | | | |
|---|---|---|---|
| 2,688,525 | 9/1954 | Lindstrom | 312/196 X |
| 3,174,721 | 3/1965 | Risser | 49/9 X |
| 3,373,703 | 3/1968 | Barecki | 108/50 |
| 3,491,973 | 1/1970 | Hartbaur | 232/43.2 X |
| 3,635,174 | 1/1972 | Ball | 312/194 X |
| 3,789,530 | 2/1974 | Brookes | 40/124 |
| 3,866,549 | 2/1975 | Berton | 312/195 |

*Primary Examiner*—James T. McCall

*Attorney, Agent, or Firm*—George A. Rolston

[57] ABSTRACT

A cheque writing desk for use in conjunction with a customer control line rail system, which may be arranged in an essentially "free standing" manner in any appropriate location in the customer area of a bank, trust company or other location, and which may be used on one side for the writing of cheques and the like, and having a partition extending along the table, carrying deposit slips and the like on one side, and which on its reverse side may carry advertising pamphlets for the bank or any other purpose. The cheque writing desk has one or more couplings by means of which it may be connected with the line rail system at or about the point where the customers enter the line rail system. In this way, the customers may write their cheques, or deposits on one side of the desk just prior to entering the line rail system, and as they pass around the desk to enter the line rail system, they may then examine the advertising material at a location in which they are bound to be waiting for a few minutes, and may, therefore, give their attention to such material without distraction.

7 Claims, 6 Drawing Figures

CHEQUE WRITING DESK AND CONTROL SYSTEM

The present invention relates to a cheque writing desk for use in banks, loan companies and the like, which is adapted to be incorporated in a line rail customer control system.

BACKGROUND OF THE INVENTION

In banks, trust and loan companies and the like, the flow of customers to the various tellers or wickets is usually controlled by the use of a system of portable rails or ropes. Such rails or ropes are supported at spaced intervals by posts which may be simply arranged on the floor of the area in front of the customer wickets. Usually, the lines or ropes and posts are laid out in such a manner that a queue of customers will form, often in a zigzag fashion, and customers will move one at a time from a suitable gateway at the end of the control system, to whichever teller is free.

One of the problems in customer control systems of this type, is that the bank or similar institution will usually have provided one or more cheque writing desks around the walls of the space. The flow of customers will then normally take place from the entrance door, to the cheque writing desk, and then back to the entry to the customer control rail system. Sometimes this results in confusion of the customers, and in other cases, the customers will move on criss-crossing paths across the customer area of the bank with consequent inconvenience. This is particularly so where the line control system occupies a substantial area of the customer area of the bank, so that customers are obliged to walk around the outside of the area to and fro to get to the cheque writing desks, and then back to the entry point.

It is also common practice in banks, trust companies and the like to provide displays of bank advertising material, and in some cases displays of advertising material belonging to prominent customers of the bank. Bank advertising will usually offer a variety of customer services such as consumer loans, safety deposit boxes, savings plans, charge plate facilities, and the like, which the customer may wish to discuss with the teller, or some other employee.

It is, therefore, desirable that the advertising material shall be so positioned that the customer may read it while his attention is not distracted elsewhere.

In the past, such advertising displays have usually been either erected directly on the tellers wicket, or else on a wall of the customer area of the bank, or on free standing displays. In either case, the customer, when at that location, is usually engaged in either making entries in his pass book, writing a cheque or else dealing with the teller.

He is not, therefore, in a position to pay too much attention to the advertising material itself.

In addition, banks have encountered difficulties encouraging customers to make out their own cheques or deposits and it is desireable to facilitate this procedure to save the time spent at the teller's wicket.

BRIEF SUMMARY OF THE INVENTION

The invention, therefore, seeks to provide a cheque writing desk for use in conjunction with a customer control line rail system, which may be arranged in an essentially free standing manner in any appropriate location in the customer area of a bank, and which may be used on one side for the writing of cheques and the like, and having a partition extending along the table, carrying deposit slips and the like on one side, and which on its reverse side may carry advertising pamphlets for the bank. The cheque writing desk has couplings by means of which it may be connected with the line rail system at or about the point where the customers enter the line rail system. In this way, the customers may write their cheques, or deposits on one side of the desk just prior to entering the line rail system, and as they pass around the desk to enter the line rail system, they may then examine the advertising material at a location in which they are bound to be waiting for a few minutes, and may, therefore, give their attention to such material without distraction.

In accordance with the invention, such a cheque writing desk will incorporate a generally rectangular desk platform having a longitudinal offset partition or division dividing the platform portion into a wider area on one side and a narrower area on the other, the wider area preferably being used for the writing of cheques, and incorporating a plurality of paper compartments on opposite sides of the partition, for holding various paper items such as deposit slips, and counter cheques on one side and advertising material on the opposite side of the offset partition, and further incorporating a waste bin as part of the platform, for reception of waste paper. At either end of the platform suitable connection means will be provided for connecting with the line rail system, and a pair of legs will be located beneath the platform for supporting the platform in a free standing manner as part of the customer control line rail system. Preferably, such legs will be removable for ease of shipping, and will be of the same design and shape as those used in the line rail system so that the entire system incorporating the cheque writing desk and the line rail system will have a generally similar appearance.

Preferably, in accordance with the invention, the platform portion of the desk will be essentially in the shape of an inverted box, having a horizontal surface, providing a working surface platform, and having four downwardly dependent vertical side walls, and incorporating a removable waste bin within the shape enclosed by the downwardly dependent vertical side walls, the removable waste bin being normally concealed thereby, and having an opening, registering with a suitable opening in the horizontal surface, whereby waste material may be removed from time to time.

In one form of the invention, the legs are attached to the underside of such a platform structure by means of horizontal support bars extending across the platform, within the space enclosed by the downwardly dependent walls, and incorporating downwardly dependent connecting rod members within the legs adapted to be releaseably connected with the lower ends of the legs, whereby the legs may be firmly attached to the platform, to provide a solid, steady table.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF A SPECIFIC EMBODIMENT

Figure 1:
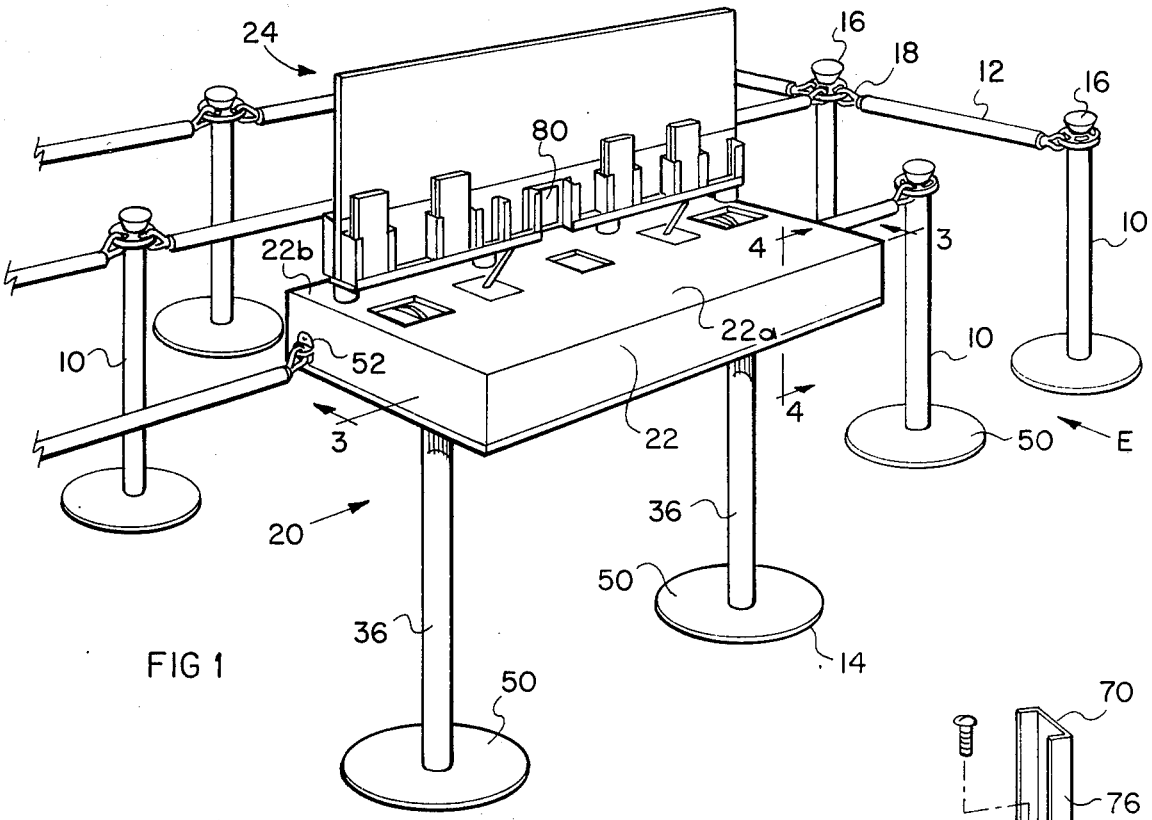
FIG. 1 is a perspective illustration showing the cheque writing desk according to the invention shown in association with a line control system.
Figure 6:
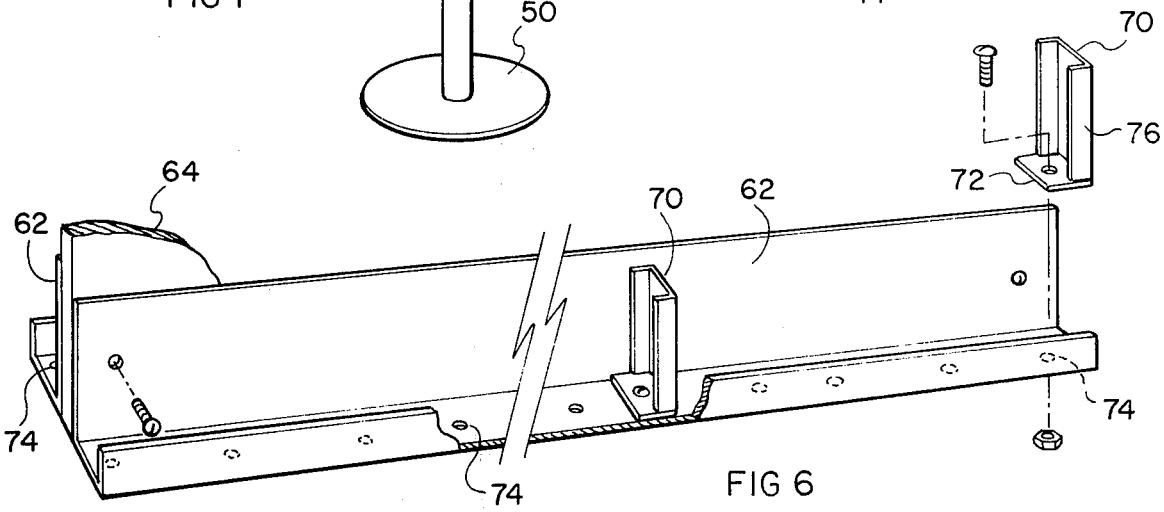
FIG. 6 is a perspective of a detail of FIGS. 3 and 4.
Figure 2:
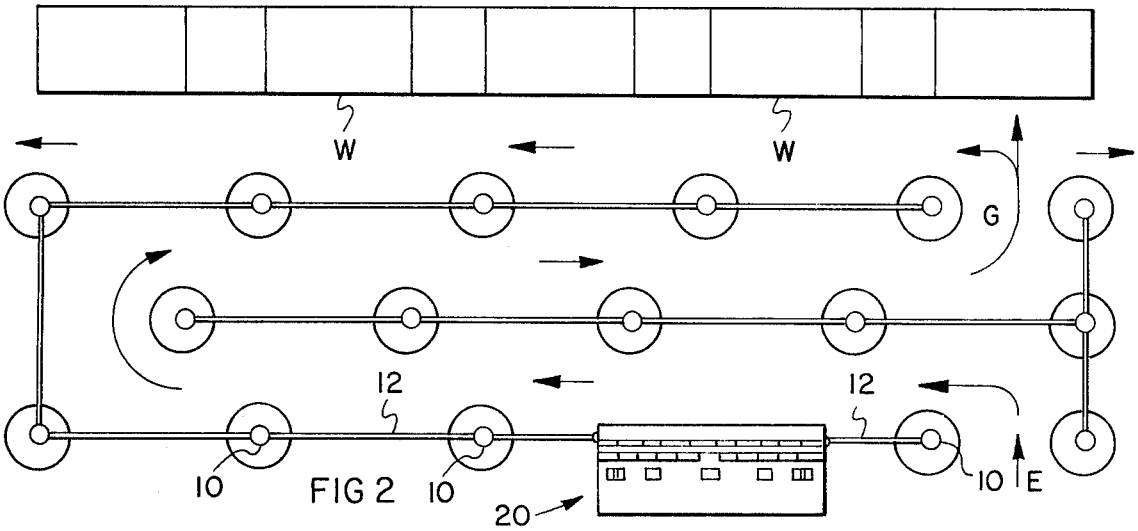
FIG. 2 is a schematic plan view showing a typical lay-out of a customer control line rail system incorporating the cheque writing desk according to the invention.

Referring now to FIGS. 1 and 2, it will be seen that the movement of customers in the customer area of an institution such as a bank, trust or loan company and the like is controlled by means of a line rail post system consisting of a plurality of free standing posts 10, and a plurality of rails 12 linked thereto in any suitable manner. The posts 10 have, in the example shown, circular bases 14 which are relatively heavy, and some form of ornamental top member 16. Connection means 18 are provided adjacent the top of each post, for inter-connection with posts 12.

As shown in FIG. 2, the line and rail posts may be arranged in the form of a zigzag path extending from an entry point E to a gate G. The customers enter at point E and will wait between the line rails until they reach the gate G, at which point they will move to the wicket W of the next teller that becomes available.

Such line post rail systems are well-known in the art, and in some cases, involve the use of posts and chains or some form of ornamental rope-like device. In all cases, however, the objective is the same, namely to organize the customers into a steady flow from one point to another, and thereby insuring a regular flow of customers to tellers as they become available.

Similarly, the arrangement shown in FIG. 2 is purely schematic, and any arrangement suitable for the lay-out of the particular bank or other institution, and suitable to the normal customer volume experienced, may be employed in a manner well understood in the art.

Figure 4:
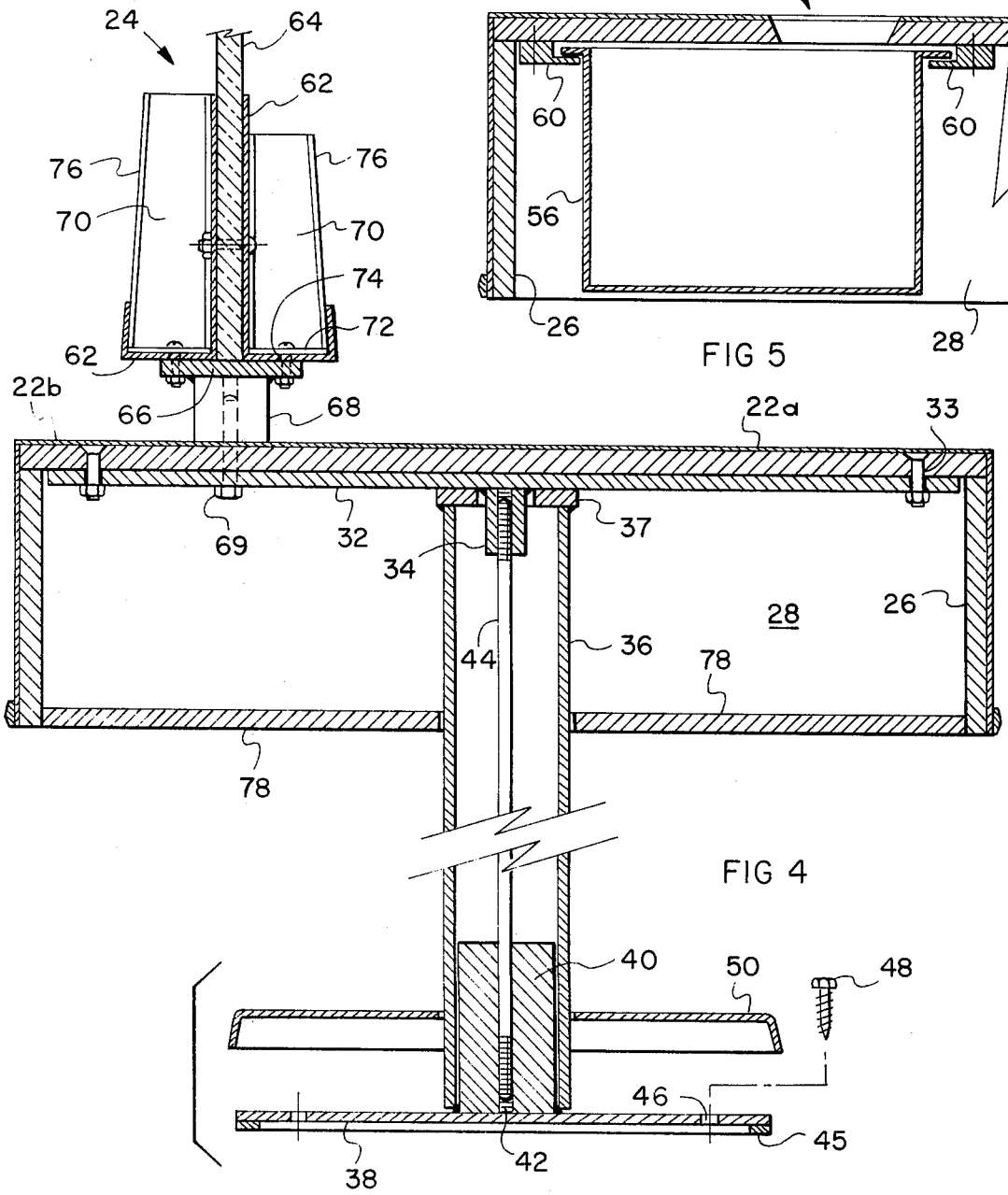
FIG. 4 is a section along the line 4—4 of FIG. 1.

In accordance with the invention, the cheque writing desk is shown generally as 20 and comprises a generally horizontal platform portion 22 divided into two portions, namely a wider portion **22*a* and a narrower portion 22*b*, by means of a vertical partition 24 (see FIG. 4**).

Figure 3:
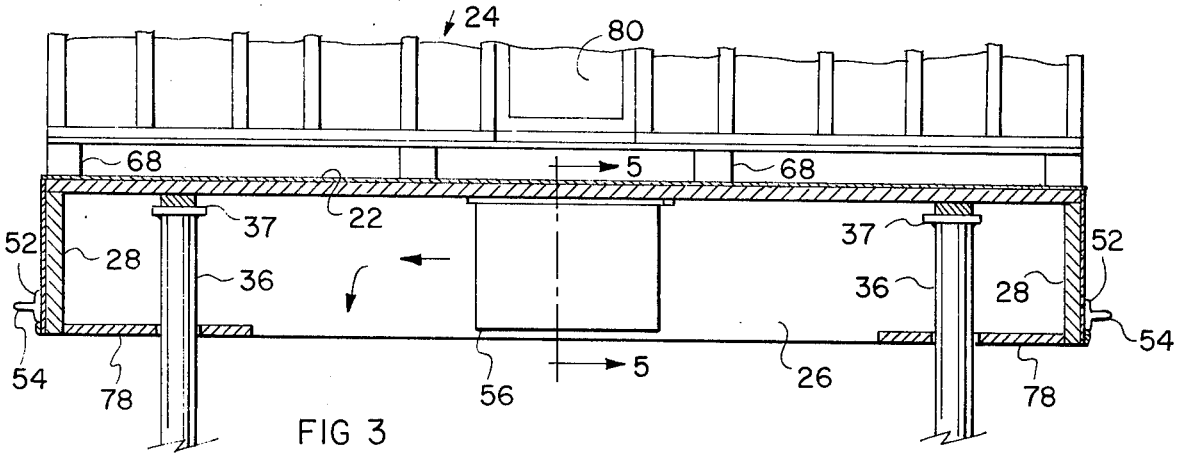
FIG. 3 is a section along the line 3—3 of FIG. 1.
Figure 5:
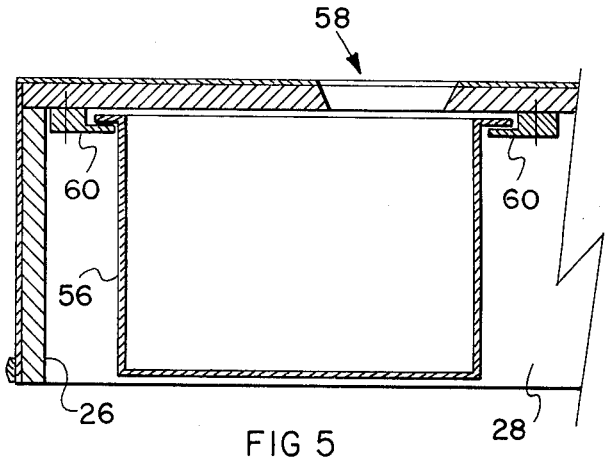
FIG. 5 is a section along the line 5—5 of FIG. 3.

As is shown in FIGS. 3 and 4, the horizontal platform 22 is surrounded by four downwardly dependent side walls, namely front and back side walls 26, and end walls 28, providing a generally rectangular enclosure having an open bottom.

Within the rectangular enclosure defined by the side walls, in this particular embodiment, a pair of transverse metal support bars 32 are provided, fastened thereto by bolts 33 or the like.

At the center of the bars 32, there is attached a downwardly dependent stub portion 34, preferably being of hollow tubular construction, provided with interior threading.

The legs 36 of the desk 20 are of hollow tubular construction, and are preferably provided with upper ends formed by the flat bearing discs 37 fitting around stub portions 34.

At the lower ends of the legs 36, heavy round base portions 38 are provided, having bosses 40 extending upwardly therefrom. Bosses 40 make a snug fit within legs 36 and have threaded bores 42. Threaded rods 44 extend within legs 36, between stub portions 34 and bosses 40 and are tightened up so as to secure legs 36 firmly in position.

The legs 36 and bases 38 preferably match the appearance and dimensions and shaping of the legs 10 and bases 14 of the line rail post system so as to provide for continuity of appearance throughout the system.

Bases 38 may have an annular foot portion 45 to engage the floor, and bolt holes 46 for receiving bolts 48 so that they may be bolted down if required.

Cover plates 50 fit freely around legs 36 and overlie and conceal bases 38.

Attached to the exterior of the two end walls 28 are locking plates 52. Preferably, the locking plates 52 are off-set with respect of the central longitudinal axis of the platform 22, and are, in fact, aligned with the location of the partition 24. It will be noted that the plates 52 and rings 54 are located at a lower level than the working surface of platform 22.

This ensures that the working surface may be at a suitable height for customers standing at it, while the rings 54 are at about the same height as the tops of the posts 10, so that the rails 12 remain essentially horizontal, when connected with the rings 54. Locking plates 52 have ring portions 54 for inter-connection with the ends of adjacent line rails 12 in any suitable manner.

Removable waste paper bins 56 made of sheet metal of the like, are preferably provided in the rectangular space beneath the platforms 22, having upwardly directed openings, communicating with waste paper openings 58 located on the wider side portion **22*a* of the platform 22**.

Suitable retaining brackets 760 are provided for retaining the bins 56 in position, the bins 56 being slidably removable from the brackets 60 for emptying.

As best shown in FIG. 4, the partitions 24 may be comprised of a pair of longitudinally L-shaped channel members 62, arranged back to back, and sandwiching between them a vertical partition panel 64. The partition panel may be made of any suitable material, for example transparent plastic material. The two channel members 62 are mounted on a longitudinal support bar 66. The support bar 66 is provided at spaced intervals with support columns 68, the support columns 68 being held in position by means of bolts 70 extending through the platform portion 22, and fastened in any suitable manner to the support bar 66.

In order to support supplies of paper forms, the longitudinal channels 62 are provided with a number of generally L-shaped divider members 70 having horizontal attachment portions 72. The channels 62 are provided with a series of spaced apart holes 74, and the divider members 70 may be fastened in adjustable locations along the length of the channel members 70 so as to suit paper forms of different dimensions. Preferably, the partition members 70 will have one or more retaining flanges 76 to assist in retaining the paper forms in position.

In order to further improve the appearance of the unit, lower panels 78 may be provided at each end of the table having a suitable opening for receiving the legs 36 therethrough.

It will of course be appreciated that the locking plates 52 will normally be removable so that two or more such desk units may be arranged side by side, being bolted together in any suitable manner by bolts passing through the adjacent abutting end walls, thereby providing for greater cheque writing capacity.

The partition may also incorporate a frame 80 for receiving interchangeable calendar cards, facing the side 22*a*.

Various modifications may be made. For example, if the desk is used at one end of a line rail system, only one connector plate 52 will be required.

If desired, the partition may be made opaque, or of any suitable material, providing greater privacy for persons using the cheque writing side 22*a*, although in practice the presence of advertising material on the opposite side of the partition will usually ensure privacy from persons who have already entered the line rail system.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A cheque writing desk unit for use in a customer control line rail system as a portion of such system, said system having a series of posts of predetermined height, and rail means interconnected therewith, the rail means having connection means thereon, said desk unit comprising;

a platform of predetermined length and width defining a working surface suitable for use by persons standing;

leg means supporting said platform at a suitable elevation and leaving a vacant space therebeneath between the platform and the floor whereby a person may stand close to the platform;

partition means extending upwardly from said platform, along the length thereof, and offset to one side to define a wider and a narrower portion of said platform on opposite sides of said partition means;

proper holder means on both sides of said partition means, and, line rail interconnection means on at least one end of said platform, below the top surface of said platform, for interconnection with said rail means, whereby said rail means may be interconnected between a said post and said interconnection means in an essentially horizontal manner and freely supported therebetween, without applying tension to said platform.

2. A cheque writing desk unit as claimed in claim 1 wherein said platform includes downwardly dependent end walls at either end thereof, said interconnection means being fastened on at least one of said end walls, and aligned with said partition means whereby the line rails system, and partitions may all be arranged in alignment.

3. A cheque writing desk unit as claimed in claim 2 including two said interconnection means, one on each said end wall, aligned with said partition means.

4. A cheque writing desk unit as claimed in claim 1 including a plurality of paper holder members, and bracket means on each side of said partition means holding said paper holder members, and adjustable means for fastening said paper holder members in different positions on said bracket means.

5. A cheque writing desk unit as claimed in claim 1 including a waste receptacle located beneath said platform, means releasably holding said waste receptacle in position, and opening means in said platform registering with said waste receptacle for access thereto.

6. A cheque writing desk unit as claimed in claim 1 wherein said line rail system incorporates posts of predetermined shape, and having foot portions at the lower ends thereof of a predetermined shape, and wherein said leg means supporting said platform have a predetermined shape similar to that of said posts, and including foot means at the lower ends of said leg means having a shape similar to said foot means of said posts whereby the posts, and leg means provide a matching appearance.

7. A cheque writing desk unit as claimed in claim 6 wherein said leg means comprises two leg members, located spaced apart from one another towards opposite ends of said desk unit, each said leg member comprising a hollow cylindrical tubular member having openings at both ends, a stub member having a female thread fastened beneath said platform in a downwardly dependent manner, and adapted to be received within the opening means at one end of said cylindrical member, and including foot means adapted to be connected at the lower end of said cylindrical member, and including a central boss having a female threaded opening therein extending upwardly from said foot means and adapted to be received in the opening means at the other end of said cylindrical member, threaded rod means adapted to extend within said cylindrical member between said stub member and said boss, and adapted to be tightened up whereby to secure said cylindrical member in position, and removable cover plate means for said foot member.

* * * * *